US005131235A

United States Patent [19]

Watanabe

[11] Patent Number: 5,131,235

[45] Date of Patent: Jul. 21, 1992

[54] COOLING SYSTEM HAVING COOLANT MASS FLOW CONTROL

[75] Inventor: Yujiro Watanabe, Nagoya, Japan

[73] Assignee: Aisin Seiki Kabushiki Kaisha, Kariya, Japan

[21] Appl. No.: 678,197

[22] Filed: Apr. 1, 1991

[30] Foreign Application Priority Data

Mar. 31, 1990 [JP] Japan ..... 2-87135

[51] Int. Cl.[5] ..... F28B 9/00

[52] U.S. Cl. ..... 62/172; 62/197; 62/402; 62/513

[58] Field of Search ..... 62/172, 87, 113, 117, 62/196.1, 196.3, 197, 401, 402, 513

[56] References Cited

U.S. PATENT DOCUMENTS 3,095,710 7/1963 Clark ..... 62/117
3,200,613 8/1965 Zotos ..... 62/402
3,321,930 5/1967 La Fleur ..... 62/402 X
4,248,055 2/1981 Day, III et al. ..... 62/196.3
4,835,979 6/1989 Murry et al. ..... 62/172

*Primary Examiner*—Albert J. Makay
*Assistant Examiner*—John Sollecito
*Attorney, Agent, or Firm*—Oblon, Spivak, McClelland, Maier & Neustadt

[57] ABSTRACT

A cooling system includes a turbo compressor for compressing a coolant and a turbo expander fluidically connected to the turbo compressor via one or more heat radiators. In order to insure a constant expansion ratio in the turbo expander at all operating temperatures, without varying the rotational speed of the turbo compressor, a first controller controls the flow rate of coolant to the turbo expander while a second controller in a bypass passage controls a flow rate of coolant bypassed to the intake side of the turbo compressor. The first and second controllers are controlled by a control unit sensitive to the coolant temperature at the intake side of the turbo expander.

6 Claims, 4 Drawing Sheets

COOLING SYSTEM HAVING COOLANT MASS FLOW CONTROL

BACKGROUND OF THE INVENTION

1. Field of the Invention

This invention relates to a cooling system, especially to a cooling system using a turbo compressor and a turbo expander. In this kind of cooling system, the temperature goes down below 200 K and the cooling system is used for liquefying nitrogen, hydrogen or helium, and cooling an infrared sensor or processors for a super computer or a cryopump.

2. Description of Related Art

A conventional cooling system provides a reciprocating or screw type compressor and a turbo expander. In this cooling system, a compressor compresses a coolant such as helium and a turbo expander expands the coolant. On the other hand, there is also known a cooling system using a turbo compressor and a turbo expander as shown in FIG. 5. This cooling system, however, has not been commercialized because it is difficult to supply all the flow of coolant from the compressor to the expander.

Referring to FIG. 5, this system provides a turbo compressor 114 and a turbo expander 115. The turbo compressor includes impellers 101 and 102 driven by a high speed motor 103. The impeller 101 compresses a coolant such as nitrogen, neon or helium and the coolant goes to a radiator 104. The heat of the coolant caused by the compression is then removed by a cooling fluid such as water or air flowing through a passage 112. Then the coolant is again compressed by the impeller 102 and goes to the radiator 105. The heat of the coolant caused by the second compression step is also removed by a cooling fluid such as water or air flowing through the passage 112 in the radiator 105.

The coolant then goes into the turbine 107 of the expander 115 via the heat exchanger 106. The coolant is cooled in the heat exchanger 106 by transferring heat to a reverse flowing coolant in the heat exchanger 106. The coolant expands in the turbine 107 and drives the turbine 107 and the high speed generator 108 connected thereto. The expanded coolant is thus at a low temperature.

The expanded coolant then goes into a cooler 109 where it cools down the cooled object 110. Then the coolant goes back to the impeller 107 via the heat exchanger 106 while cooling down the coolant flowing the opposite way in the heat exchanger 106. By this cycle, a temperature in object 110 can be lowered to from −70° C. to −270° C.

FIG. 2 shows a mass flow rate of the coolant versus an expansion ratio at the turbine 107 of the turbo expander 115. When the volume flow rate of the coolant increases, an expansion ratio also increases since the area of the turbine 107 is constant. Similarly, if the temperature is constant, an expansion ratio increases when a mass flow ratio (g/sec) of the coolant increases. At a low temperature such as 100 K (−73° C.), as shown by the solid line in FIG. 2, a mass flow is ml at the steady state pressure r1 at the steady state point A.

However, when the cooling system is started at room temperature (dash lines in FIG. 2), a temperature of the coolant at the turbine 107 is about room temperature, e.g., 300K (27° C.). The volume of the coolant is proportional to absolute temperature, so that the same mass flow as at −73° C. now causes about a triple volume of the flow as compared to flow at −73° C. This increases the expansion ratio to r1', which is bigger than the steady ratio r1. In other words, at the steady state point B a mass flow of the coolant at room temperature for an expansion ratio r1 is m0, which is less than that of the coolant at a lower temperature.

FIG. 3 shows a graph of the coolant as compressed by both the impellers 101 and 102. By ignoring the pressure loss at the radiators 104 and 105 and the heat exchanger 106, an expansion ratio at the turbine 107 is equal to the sum of the compression ratios of the impellers 101 and 102. The impellers 101 and 102 have a surge line as shown in FIG. 3 and if the operation is conducted above this surge line, vibration of the coolant makes the system inoperative. At the steady point D of the turbo compressor 114 with a revolution speed of N1, a mass flow is ml and a compression ratio is r1.

At the beginning of the operation, a compression ratio is r1' shown by point C in FIG. 2. If all the mass flow m1 is sent to the turbine 107, this causes a surge since r1' is much higher than r1. On the other hand, at the beginning of operation a mass flow applied to the turbine 107 at the compression ratio r1 can be as low as a mass m0 as shown by a point B in FIG. 2. In order to reduce the mass flow to m0 at this time, the revolution speed may be reduced to N0. However, a compression ratio r2 which causes a surge goes down to the point F at such low rotational speeds. Therefore, a surge is caused if a high compression ratio of r1 is applied at low rotational speed N0 (point E in FIG. 3).

As explained above, this coolant system could work if a temperature of the coolant is low enough at the turbine 107. However, the coolant system cannot start at room temperature because of surging.

SUMMARY OF THE INVENTION

An object of the present invention is to provide a cooling system improving the above-mentioned drawbacks, especially a cooling system which can work at room temperature.

Other objects will be apparent from an understanding the invention.

In accordance with this invention, a cooling system comprises a turbo compressor compressing a coolant, a heat radiator for absorbing the heat of the coolant compressed by the compressor, a turbo expander which expands the coolant from the radiator, a first flow controller connected between the radiator and the turbo expander and which controls a flow of the coolant from the radiator to the turbo expander, a bypass passage directly connecting the radiator and the intake side of the turbo compressor, and a second flow controller placed in the bypass passage and which controls a flow of the coolant from the radiator to the turbo compressor.

In accordance with this invention, at the beginning of the operation, the first and second flow controllers control the coolant flows in accordance with the coolant temperature. The first flow controller controls a coolant mass flow from the radiator to the turbo expander. The second controller controls a coolant mass flow from the radiator back to the turbo compressor via the bypass passage. Thus a mass flow of the coolant going into the turbo expander can be controlled with respect to a temperature which varies from room temperature to a low temperature.

In accordance with the present invention, a volume flow of the coolant from the turbo compressor to the turbo expander is the same even if a temperature varies. If a temperature of the coolant is high and a volume of the coolant is large at the start of the cooling system, the first flow controller controls the mass flow of the coolant which flows into the turbo expander and the second flow controller controls the mass flow of the coolant flowing through the bypass passage. Thus the system can keep an expansion ratio within limits and keep a volume flow of the coolant the same as the low temperature. This prevents the cooling system from surging and reduces cooling time.

BRIEF DESCRIPTION OF THE DRAWINGS

The objects and advantages of the invention will become apparent from the following detailed description of preferred embodiment thereof in connection with the accompanying drawing in which.

DETAILED DESCRIPTION OF PREFERRED EMBODIMENTS OF THE INVENTION

Figure 1:
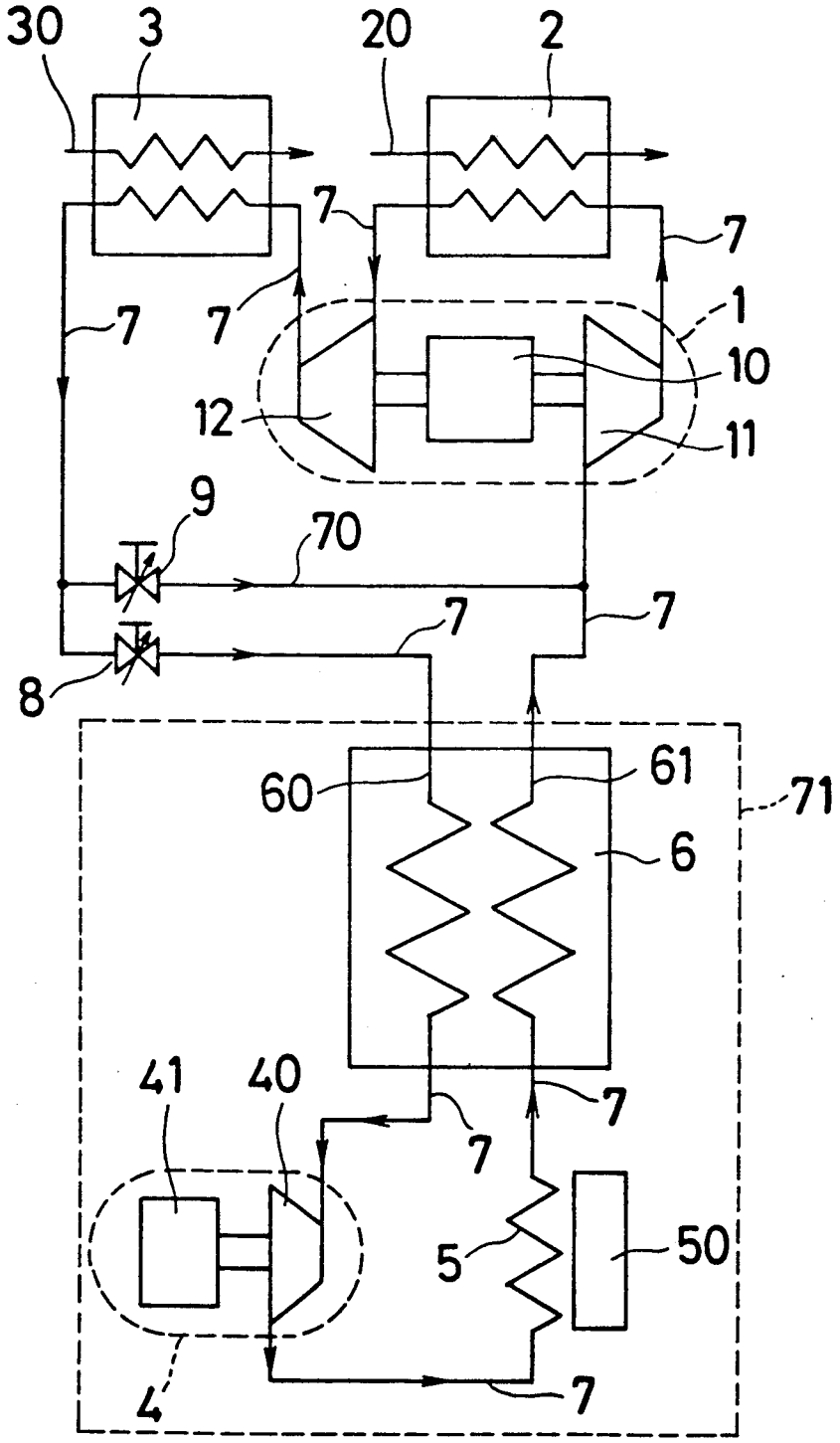
FIG. 1 is a diagram of a cooling system in accordance with the present invention.

As shown in FIG. 1, a cooling system of the present invention is provided with a turbo compressor 1 which compresses a coolant, the first radiator 2 and the second radiator 3 which radiate the heat from the coolant compressed by the compressor 1, a turbo expander 4 which expands the coolant delivered from the radiators 2 and 3, a cooler 5 which transfers heat to the low temperature expanded coolant from a cooled object 50 placed adjacent to the cooler 5, a heat exchanger 6 which exchanges heat between the coolant flow in a first flow passage portion of the flow passage 7 from the second radiator 3 to the turbo expander 4 and the flow in a second flow passage portion of the flow passage 7 from the turbo expander to the intake side of the turbo compressor 1.

A first flow controller 8 is placed between the second radiator 3 and the heat exchanger 6 and controls the coolant flow from the second radiator 3 to the turbo expander 4 via the heat exchanger 6. A bypass passage 70 directly connects the second radiator 3 with the intake side of the turbo compressor 1, and a second flow controller 9 is placed in the bypass passage 70. The turbo compressor includes a high speed electric motor 10 which drives the first impeller 11 and the second impeller 12, both of which are connected to the motor 10. The first radiator 2 is placed in the portion of the passage 7 between the first impeller 11 and the second impeller 12 of the turbo compressor 1 and is provided with a passage 20 through which flows a heat exchange fluid which removes compression heat from the coolant. The second radiator 3 is placed in the portion of the passage 7 between the second impeller 12 and the heat exchanger 6 and is provided with a passage 30 through which flows a heat exchange fluid which further removes the compression heat from the coolant. The turbo expander 4 includes a turbine 40 and a high speed generator 41 driven by the turbine 40. The flow controllers 8 and 9 are valves which can be manually controlled by an operator. The turbo expander 4, the cooler 5, the cooled object 50 and the heat exchanger 6 are placed in a heat isolated vacuum case 71.

First the operation will be explained when the first controller 8 fully opens the passage 7 and the second controller 9 closes the bypass passage 70.

The coolant is compressed by the impeller 11 connected to the motor 10 of the turbo compressor 2. This compressed coolant goes into the first radiator 2 and the cooling fluid, i.e., water, air, etc., flowing in the passage 20 removes compression heat from the coolant. The coolant is further compressed in the second impeller 12 and goes into the second radiator 3, and the cooling fluid flowing in the passage 30 removes the compression heat from the coolant. The coolant then goes into the passage 60 of the heat exchanger 6 and its heat is further removed. The coolant then goes into the turbo expander 4 and rotates the turbine 40 of the turbo expander 4 to operate the generator 41. The energy stored in the coolant is converted into power for driving the turbine 40. At the same time, the coolant temperature drops. The coolant then goes into the cooler 5 and cools down the cooled object 50. The coolant returns to the turbo compressor 1 via the passage 61 of the heat exchanger 6 and takes heat from the coolant flowing in the passage 60 of the heat exchanger 6. This process can cool the cooled object 50 down to −170° C. to −269° C.

Figure 2:
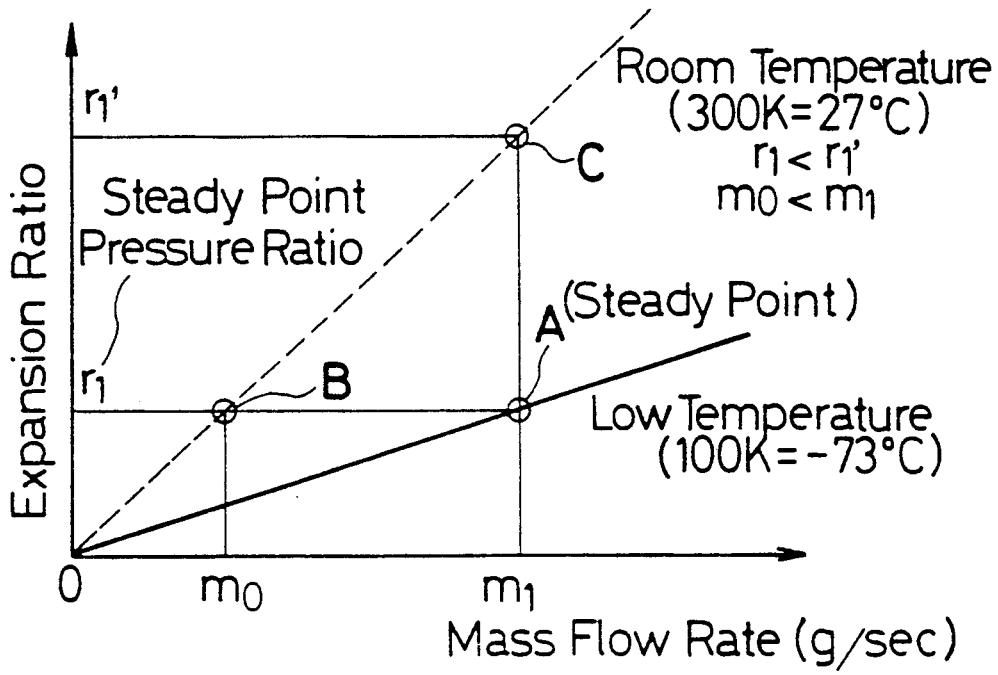
FIG. 2 is a graph showing the mass flow rate versus the expansion ratio of the turbo expander of the cooling system in FIG. 1.
Figure 3:
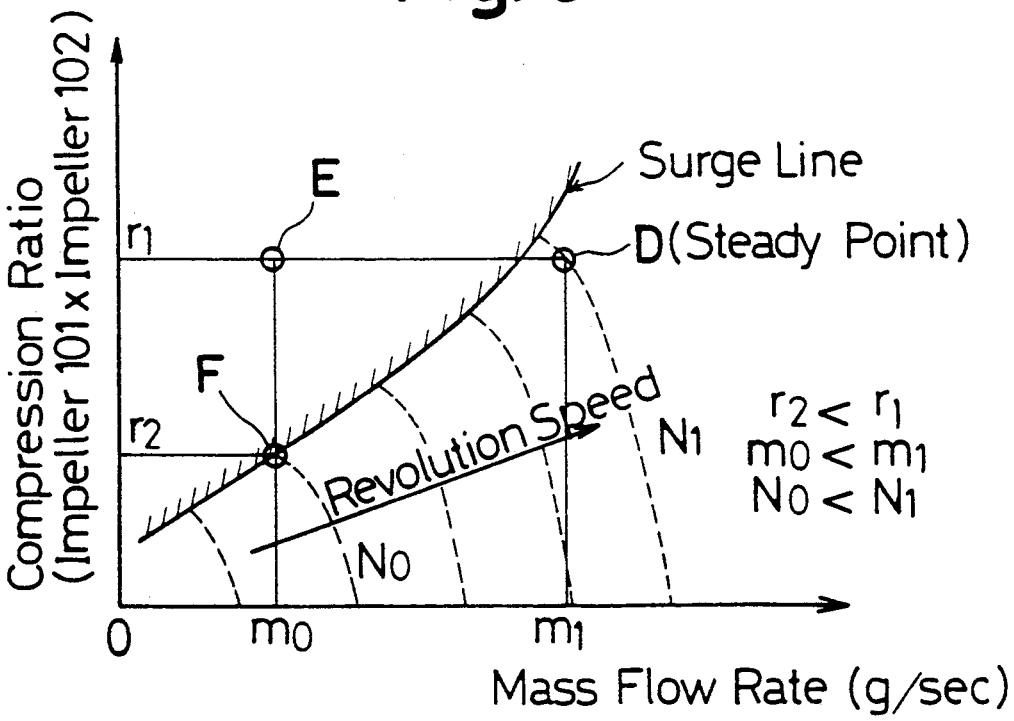
FIG. 3 a graph showing the mass flow rate versus the compression ratio of the turbo compressor of the cooling system in FIG. 1.

When the system starts operating at room temperature such as 27° C. (300K), the first controller 8 is operated so as to reduce the flow rate in the passage 7. The second controller 9 is operated so as to open the bypass passage 70. Thus the flow of the coolant is divided between the turbo compressor 4 and the bypass passage 70. The turbo compressor 1 can operate at the point D (mass flow m1, compression ratio r1) shown in FIG. 3. The first and second controllers 8 and 9 are operated so that the mass flow m0 of the coolant goes into the passage 7 and the mass flow (m1−m0) of the coolant goes into the bypass passage 70. In FIG. 2, the expansion ratio is r1 when the mass flow m0 of the coolant flows into the turbo expander 4. Therefore, the turbo compressor 1 can be operated without any surges. As the temperature of the coolant at the turbo expander 4 falls, the mass flow of the coolant should go up from m0 to m1. The controllers 8 and 9 are operated so that the mass flow at the passage 7 approaches ml and the mass flow at the bypass passage 70 approaches zero. This makes the turbo compressor 1 operation stable.

Figure 4:
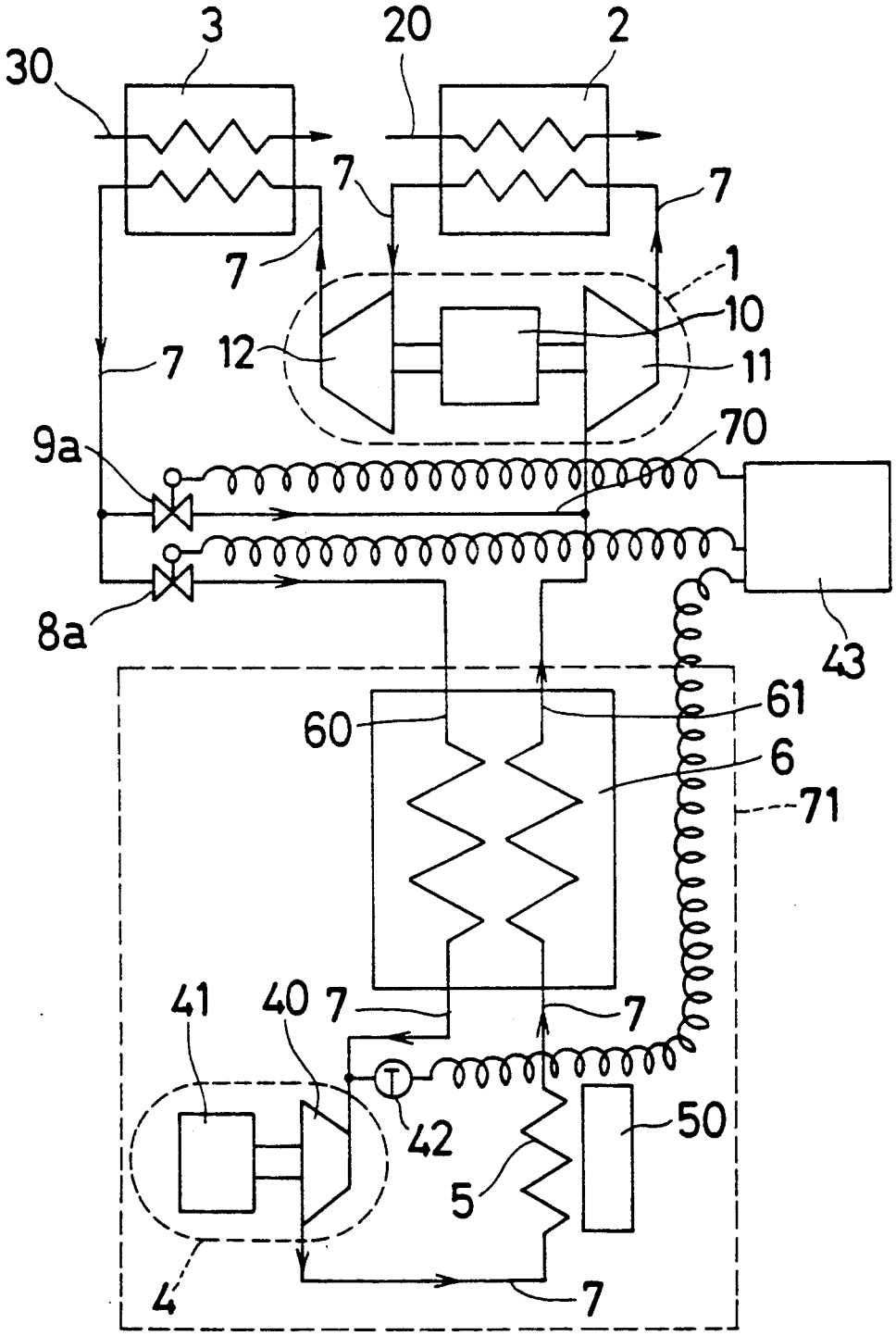
FIG. 4 is a diagram of a second embodiment of the cooling system in accordance with the present invention.
Figure 5:
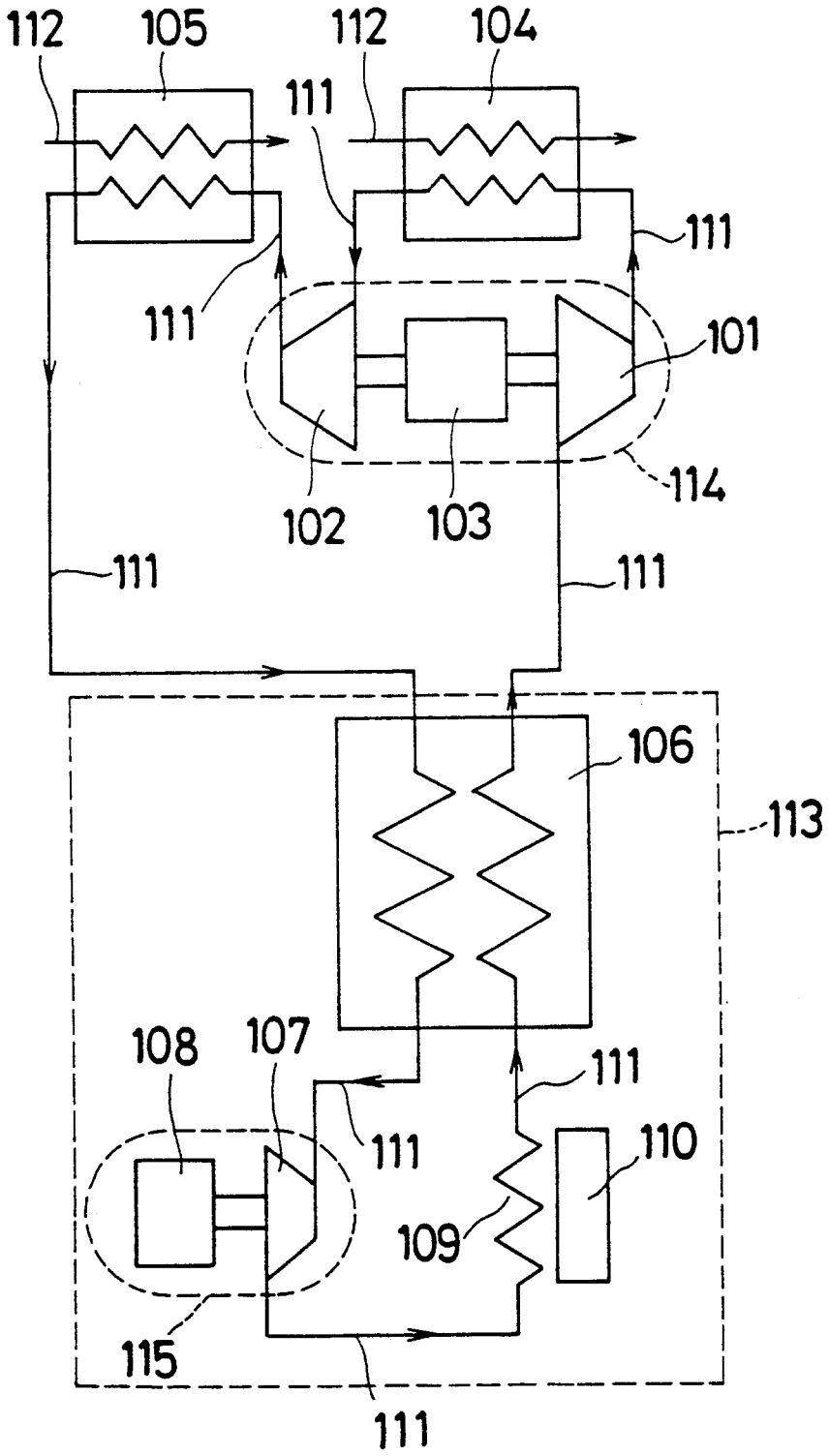
Fig. 5 (PRIOR ART)
FIG. 5 is a diagram of a conventional cooling system.

FIG. 4 shows the second embodiment of the present invention. Referring to FIG. 4, this embodiment is provided with electric (automatic) valves **8*a* and 9*a* instead of the valves 8 and 9 in the first embodiment and a temperature sensor 42 placed at the inlet of the turbo expander 4. A controller unit 43 receives signals from the temperature sensor 42 and controls the electric valves 8*a* and 9*a* so that the expansion ratio is r1 at all sensed temperatures; that is, so that the volume flow rate of the coolant to the turbo expander remains constant at all measured temperatures. The rest of the second embodiment is as same as the first embodiment as explained above. The controller unit 43 may include a micro-processor to calculate the timing and the operation of the electric valves 8*a* and 9*a* based on the comparison between the temperature signals from the temperature sensor with data stored in the micro-processor. The controller unit 43 controls the electric valves 8***a* and 9*a* to control the mass flow of the coolant. The controller unit 43 also controls the mass flow of the coolant at the passage 7 to produce a constant flow volume while the flow in the bypass passage 70 approaches zero as the temperature goes down.

Although the invention has been described in connection with preferred embodiments thereof, it will be appreciated by those skilled in the art that additions, substitutions, modifications, and deletions not specifically described may be made without departing from the spirit and scope of the invention as defined in the appended claims.

What is claimed as new and is desired to be secured by letters patent of the United States is:

1. A cooling system comprising;

a turbo compressor for compressing a coolant, a heat radiator fluidically connected to said turbo compressor for removing compression heat of the compressed coolant, a turbo expander fluidically connected to said heat radiator via a first flow passage for expanding the coolant from said radiator;

a first flow controller placed in said first flow passage between said radiator and said turbo expander and controlling a flow of said coolant from said radiator to said turbo expander;

a bypass passage directly connecting said radiator and an intake side of said turbo compressor;

a second flow controller in said bypass passage and controlling a flow of said coolant from said radiator to said intake side of said turbo compressor via said bypass passage;

a temperature sensing means for sensing a temperature of the coolant at an intake side of said turbo expander; and a controller unit receiving temperature signals from said temperature sensing means and comprising means for operating said flow controllers as a function of the temperature signals.

2. The cooling system of claim 1 including a second flow passage connecting a discharge side of said turbo expander to the intake side of said turbo compressor, said second flow passage including cooling means for transferring heat from an object to be cooled to the coolant in said second flow passage.

3. The device of claim 2 including heat exchanger means for exchanging heat between the coolant in said first flow passage and the coolant in said second flow passage.

4. The device of claim 1 wherein said first and second flow controllers comprise manually controlled valves.

5. The device of claim 1 wherein said first and second flow controllers comprise automatically operated valves.

6. The device of claim 1 wherein said controller unit comprises means for operating said flow controllers such that a volume flow rate of the coolant to said turbo expander is substantially constant at all temperatures sensed by said temperature sensing means.

* * * * *